US007472551B2

(12) United States Patent
May

(10) Patent No.: US 7,472,551 B2
(45) Date of Patent: Jan. 6, 2009

(54) CRYOGENIC PROCESS SYSTEM WITH EXTENDED BONNET FILTER

(75) Inventor: Douglas Henry May, Sanborn, NY (US)

(73) Assignee: Praxair Technology, Inc., Danbury, CT (US)

( * ) Notice: Subject to any disclaimer, the term of this patent is extended or adjusted under 35 U.S.C. 154(b) by 345 days.

(21) Appl. No.: 11/274,334

(22) Filed: Nov. 16, 2005

(65) Prior Publication Data

US 2008/0110203 A1 May 15, 2008

(51) Int. Cl.

| | |
|---|---|
| ***F17C 13/00*** | (2006.01) |
| ***F25J 3/00*** | (2006.01) |
| ***B01D 35/18*** | (2006.01) |
| ***B01D 35/30*** | (2006.01) |

(52) U.S. Cl. ..... 62/50.7; 62/908; 62/643; 210/181; 210/232

(58) Field of Classification Search ..... 62/50.7, 62/908, 643; 210/459, 181, 232
See application file for complete search history.

(56) References Cited

U.S. PATENT DOCUMENTS

| | | | | |
|---|---|---|---|---|
| 3,109,726 | A | 11/1963 | Karwat | |
| 3,739,593 | A | 6/1973 | Schauls | |
| 4,170,556 | A * | 10/1979 | Pall | 210/181 |
| 4,759,848 | A * | 7/1988 | Segura et al. | 210/651 |
| 5,122,175 | A | 6/1992 | Koyama et al. | |
| 5,158,106 | A | 10/1992 | McIntosh | 137/375 |
| 5,545,015 | A | 8/1996 | Scherrer | 417/360 |
| 5,860,798 | A | 1/1999 | Tschopp | |
| 6,119,480 | A * | 9/2000 | Germain et al. | 62/642 |
| 6,250,896 | B1 | 6/2001 | Lehman | 417/373 |
| 6,286,320 | B1 | 9/2001 | Riche et al. | 62/50.6 |
| 6,439,836 | B1 | 8/2002 | Pozivil | |
| 2002/0017112 | A1 * | 2/2002 | Lehman | 62/643 |
| 2007/0075011 | A1 * | 4/2007 | Germain | 210/459 |

* cited by examiner

*Primary Examiner*—William C Doerrler
(74) *Attorney, Agent, or Firm*—David M. Rosenblum

(57) ABSTRACT

A cryogenic process system wherein a solids removal filter positioned in a conduit upstream of process equipment is within a filter housing having an angled bonnet which extends to the outside of insulated housing.

7 Claims, 3 Drawing Sheets

CRYOGENIC PROCESS SYSTEM WITH EXTENDED BONNET FILTER

TECHNICAL FIELD

This invention relates generally to cryogenic process systems such as cryogenic air separation systems, and, more particularly, to the handling of cryogenic fluids within such a cryogenic process system.

BACKGROUND ART

In a cryogenic process system, cryogenic fluids, which may be in liquid, gaseous or mixed phase, i.e. gaseous and liquid, form are passed through conduit means to and from process equipment. Owing to the cold temperatures at which the cryogenic process system operates which are below 233K and can be below 150K or even lower, the conduit through which the cryogenic fluid passes is within an insulated housing. Particulate or other solid matter may be in the cryogenic fluid as it passes through the conduit and, because of this contingency, filters are used on the conduit upstream of process equipment that is sensitive to plugging. Over time such filters require cleaning or replacement necessitating entry into the insulated housing which is costly and may also be dangerous.

SUMMARY OF THE INVENTION

A cryogenic process system comprising process equipment and conduit means for passing cryogenic fluid to the process equipment, said conduit means being within an insulated housing; a filter positioned on the conduit means upstream of the process equipment, said filter being within a filter housing having a bonnet which is sealed by an access flange; said bonnet having a length which extends to the outside of the insulated housing such that the access flange is exposed to the ambient air.

As used herein the term "bonnet" means the upper portion of a filter housing.

As used herein the term "column" means a distillation or fractionation column or zone, i.e. a contacting column or zone, wherein liquid and vapor phases are countercurrently contacted to effect separation of a fluid mixture, as for example, by contacting of the vapor and liquid phases on a series of vertically spaced trays or plates mounted within the column and/or on packing elements such as structured or random packing. For a further discussion of distillation columns, see the Chemical Engineer's Handbook, fifth edition, edited by R. H. Perry and C. H. Chilton, McGraw-Hill Book Company, New York, Section 13, *The Continuous Distillation Process*. A double column comprises a higher pressure column having its upper end in heat exchange relation with the lower end of a lower pressure column.

Vapor and liquid contacting separation processes depend on the difference in vapor pressures for the components. The higher vapor pressure (or more volatile or low boiling) component will tend to concentrate in the vapor phase whereas the lower vapor pressure (or less volatile or high boiling) component will tend to concentrate in the liquid phase. Partial condensation is the separation process whereby cooling of a vapor mixture can be used to concentrate the volatile component(s) in the vapor phase and thereby the less volatile component(s) in the liquid phase. Rectification, or continuous distillation, is the separation process that combines successive partial vaporizations and condensations as obtained by a countercurrent treatment of the vapor and liquid phases. The countercurrent contacting of the vapor and liquid phases is generally adiabatic and can include integral (stagewise) or differential (continuous) contact between the phases. Separation process arrangements that utilize the principles of rectification to separate mixtures are often interchangeably termed rectification columns, distillation columns, or fractionation columns. Cryogenic rectification is a rectification process carried out at least in part at temperatures at or below 150 degrees Kelvin (K).

As used herein the term "indirect heat exchange" means the bringing of two fluids into heat exchange relation without any physical contact or intermixing of the fluids with each other.

As used herein the term "feed air" means a mixture comprising primarily oxygen and nitrogen, such as ambient air.

As used herein the terms "upper portion" and "lower portion" of a column mean those sections of the column respectively above and below the mid point of the column.

As used herein the terms "turboexpansion" and "turboexpander" mean respectively method and apparatus for the flow of high pressure fluid through a turbine to reduce the pressure and the temperature of the fluid, thereby generating refrigeration.

As used herein the term "cryogenic air separation plant" means the column or columns wherein feed air is separated by cryogenic rectification to produce nitrogen, oxygen and/or argon, as well as interconnecting piping, valves, heat exchangers and the like.

As used herein the term "compressor" means a machine that increases the pressure of a gas by the application of work.

As used herein the term "filter" means a device that traps solids and/or frozen material present in a fluid stream.

As used herein the term "cryogenic pump" means a device for increasing the head of a fluid stream at cryogenic temperatures.

Figure 1:
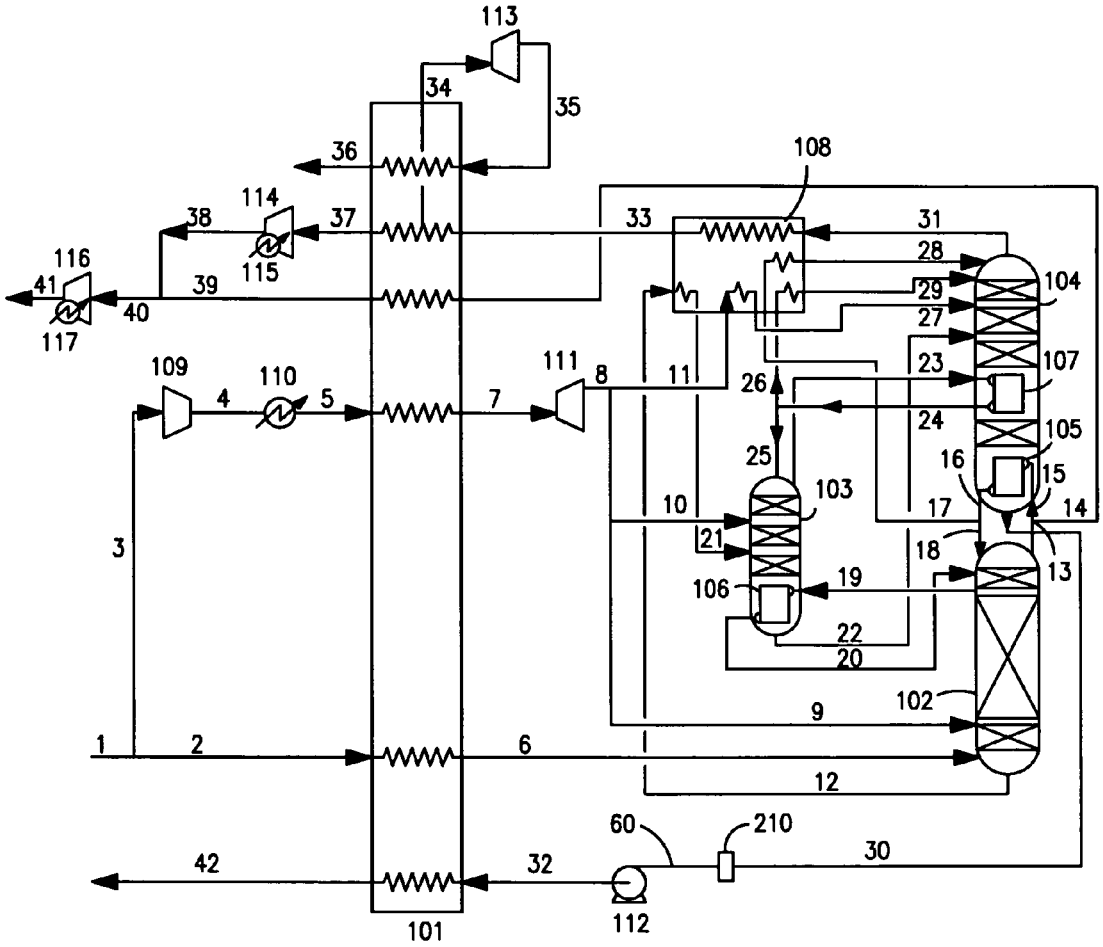
FIG. 1 is a schematic representation of one cryogenic process system, in this case a cryogenic air separation system, which can benefit from the use of this invention.

The numerals in the Drawings are the same for the common elements.

DETAILED DESCRIPTION

The invention may be employed with any cryogenic process system which employs insulated housing around cryogenic fluid bearing conduit. Examples of insulted housing include a cold box package, insulation casing, duct or skid. Examples of cryogenic process systems include a cryogenic air separation plant, a HYCO plant, an LNG plant and a gas processing plant.

One particularly useful application of the present invention is in conjunction with a cryogenic air separation process system. One such system is illustrated in FIG. 1 which includes many examples of cryogenic fluid bearing conduits and process equipment to which cryogenic fluid is passed by such conduits. In the exemplification of the invention with reference to the Drawings, the filter is positioned upstream of a cryogenic pump for filtering liquid oxygen being passed to the pump from a column. Other locations where the filter may be positioned include after the pump upstream of the primary heat exchanger 101, upstream of the waste turbine 113 and upstream of the liquid turbine 111.

The invention will be described in greater detail with reference to the Drawings. Referring now to FIG. 1, compressed, chilled, pre-purified feed air 1, which has been compressed in a main air compressor, is split into two streams; stream 2 enters the warm end of primary heat exchanger 101 and stream 3 enters booster compressor 109. In booster compressor 109, this portion of the feed air is elevated to a pressure sufficiently high for it to condense against boiling oxygen product. High pressure air stream 4 passes through cooler 110 and cooled high pressure air stream 5 enters the warm end of the primary heat exchanger. Medium pressure air 6 exits heat exchanger 101 cooled to near the dew point. The cold air 6 then enters the bottom of higher pressure rectification column 102 which forms a double column along with lower pressure column 104. The high pressure air stream 5 is liquefied in the primary heat exchanger against boiling high pressure oxygen and exits the primary heat exchanger as a subcooled liquid. Subcooled liquid air stream 7 is expanded across liquid turbine 111 to provide a portion of the cryogenic air separation plant's refrigeration needs. The liquid air stream is expanded to approximately the operating pressure of column 102. Liquid air stream 8 is split into three streams; stream 9 enters column 102 a few stages above that point at which stream 6 enters the column, stream 10 is fed to intermediate pressure column 103 a number of stages from the bottom, and stream 11 is fed to heat exchanger 108. In heat exchanger 108, stream 11 is further cooled against warming nitrogen vapor, whereupon subcooled liquid air stream 27 is fed to low pressure column 104 a number of stages from the top.

In column 102, the air is separated by cryogenic rectification into oxygen-enriched and nitrogen-enriched portions. Oxygen-enriched liquid 12 is removed from the bottom of the column, introduced into heat exchanger 108, cooled against warming nitrogen vapor, exits as a subcooled liquid 21, and is fed to an intermediate point of column 103, below the feed point for stream 10 but above the bottom of the column. Nitrogen vapor 13 exits the top of the medium pressure column 102. A portion of that vapor stream 14 is removed as medium pressure nitrogen product, and is fed to the cold end of primary heat exchanger 101. Stream 14 is warmed in primary heat exchanger 101 against cooling air streams and leaves at the warm end as warmed medium pressure nitrogen stream 39. The remaining portion 15 of stream 13 enters the condensing side of condenser/reboiler 105. Stream 15 is liquefied against vaporizing bottoms liquid in column 104. Liquid nitrogen 16 leaving condenser/reboiler 105 is split into two streams; stream 17 is sent to heat exchanger 108 and stream 18 is returned to column 102 as reflux. Stream 17 is subcooled against warming nitrogen vapor and resulting subcooled liquid nitrogen stream 28 enters low pressure column 104 at or near the top. A nitrogen enriched vapor stream 19 is removed at least one stage below the top of column 102 and enters the condensing side of condenser/reboiler 106. Stream 19 is liquefied against vaporizing bottoms liquid in column 103 and is returned to column 102 as liquid stream 20. Stream 20 enters column 102 at or above the withdrawal point for stream 19.

The intermediate pressure column 103 is used to further supplement the nitrogen reflux sent to low pressure column 104. Nitrogen vapor 23 exits the top of the intermediate pressure column 103 and enters the condensing side of condenser/reboiler 107. Stream 23 is liquefied against vaporizing liquid in the middle of column 104. Liquid nitrogen 24 leaving condenser/reboiler 107 is split into two streams; stream 25 is returned to the top of column 103 and stream 26 is fed to heat exchanger 108. Stream 26 is subcooled against warming nitrogen vapor and resulting subcooled liquid nitrogen stream 29 is fed at or near the top of low pressure column 104. Oxygen-enriched liquid 22 is removed from the bottom of column 103 and is fed to an intermediate point of low pressure distillation column 104, a number of stages above condenser/reboiler 107.

The low pressure distillation column 104 further separates its feed streams by cryogenic rectification into oxygen-rich liquid and nitrogen-rich vapor. An oxygen-rich liquid stream 30 is removed from the lower portion of column 104 and passed through filter 210 wherein it is cleaned of particulate matter. Resulting oxygen-rich liquid stream 60 is then passed to cryogenic oxygen pump 112 and raised to slightly above the final oxygen delivery pressure. High pressure liquid stream 32 is fed to the cold end of primary heat exchanger 101 where it is warmed and boiled against the condensing high pressure feed air stream. Warmed, high pressure oxygen vapor product 42 exits the warm end of primary heat exchanger 101. Nitrogen-rich vapor 31 exits the upper portion of the low pressure column 104, is fed to heat exchanger 108, is warmed against cooling liquids, and leaves as superheated nitrogen vapor stream 33.

Stream 33 enters the cold end of primary heat exchanger 101 where it is partially warmed against cooling air streams and is split into two streams. The portion of this stream not needed to complete the nitrogen product requirement is removed from an intermediate point of primary heat exchanger 101, and this stream 34 is fed to waste turbine 113 and expanded to a lower pressure. Along with liquid turbine 111, waste turbine 113 is used to generate the cryogenic air separation plant's refrigeration. Low pressure nitrogen stream 35 exits waste turboexpander 113, is fed to primary heat exchanger 101, and leaves the warm end as warmed, low pressure waste nitrogen 36. Stream 37 leaves the warm end of heat exchanger 101 as warmed, low pressure product nitrogen and is fed to the first stages of the nitrogen compressor 114 and cooled in those stages' intercoolers 115. Cooled compressed nitrogen stream 38 is mixed with nitrogen stream 39, which is at the same pressure to form stream 40. Nitrogen stream 40 is fed to the remaining stages of the nitrogen compressor 116 and cooled in those stages' intercoolers 117. Ultimately cooled high pressure nitrogen stream 41 is delivered to the end user.

Figure 2:
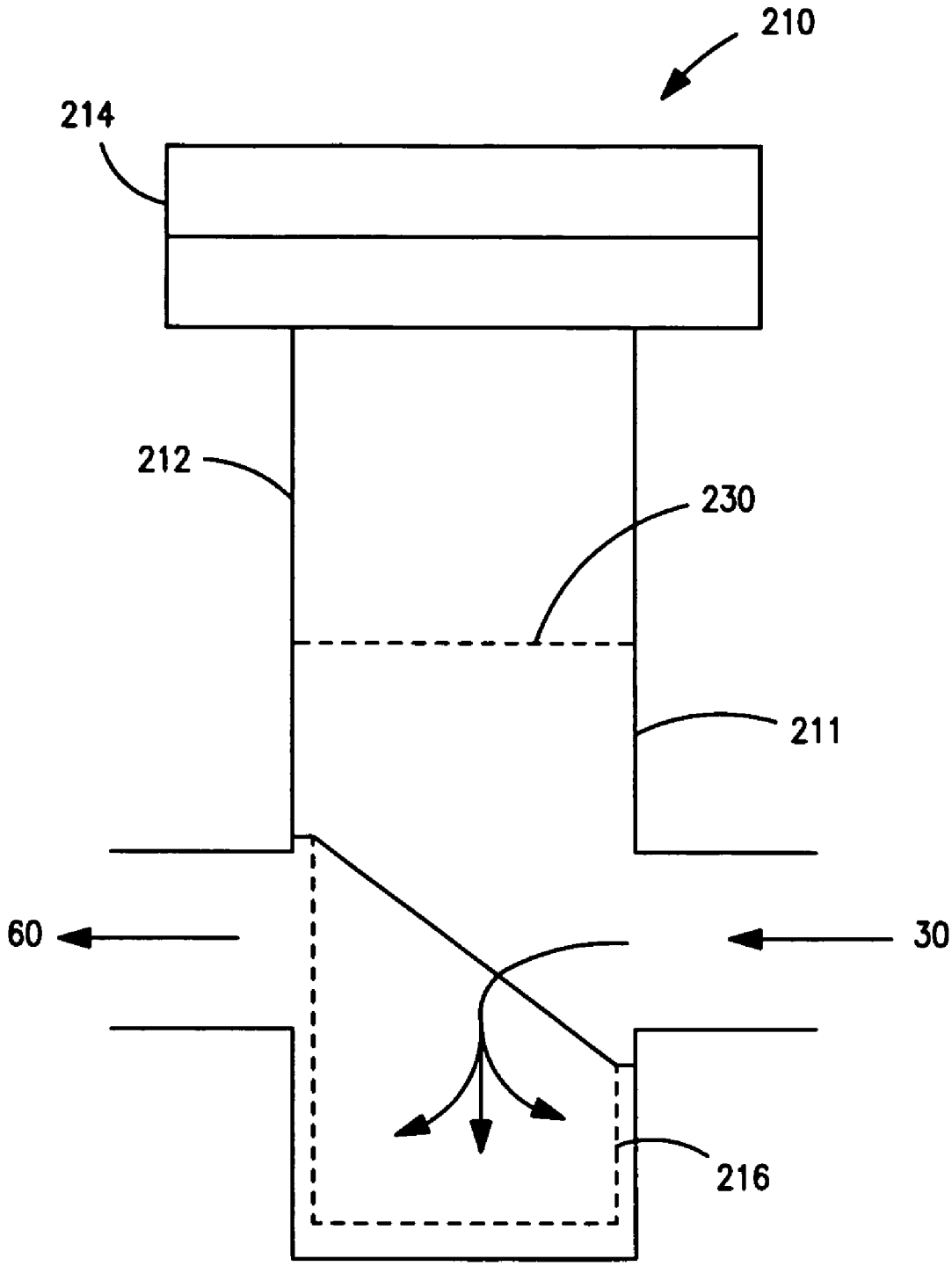
FIG. 2 is a simplified cross sectional representation of one embodiment of a filter system which may be used in the practice of this invention.

FIG. 2 is a more detailed representation of filter system 210. Referring now to FIG. 2, filter 210 comprises filter element 216 which is within filter housing 211 which has a bonnet 212 sealed by access flange 214. Filter element 216 may be made of any suitable material such as 40×40 mesh, 100×100 mesh of stainless steel or Monel. Bonnet 212 has a length which is sufficient to extend to the outside of the insulated housing. In the case where the extended bonnet filter of this invention is employed in conjunction with a cryogenic air separation plant, the extended bonnet has a length which is typically within the range of from 33 to 58 inches.

At the outside end of bonnet 212, the bonnet is sealed by access flange 214. The access flange 214 is exposed to the ambient air. When maintenance or replacement of filter element 216 is necessary, access flange 214 is removed for access to filter element 216. This enables access to filter element 216 without need to enter into the insulated housing. This has several advantages, both from cost and operations perspectives. Confined space entry is not required. The disconnecting and reconnecting of the purge gas supply to the compartment housing the extended bonnet filter 210 is eliminated. Moreover, removal and reinstallation of insulation and access covers of the insulation compartment housing the extended bonnet filter is also no longer necessary.

Preferably, bonnet 212 is at an angle with respect to the horizontal within the range of from 15 to 90 degrees. This creates a gas trap that prevents cryogenic fluid from flowing out to the exposed portion of the filter. Heat leak through the upper portion of the bonnet causes a portion of the liquid in the filter housing to vaporize, creating a gas pocket between the access flange 214 and the liquid surface 230. This prevents vaporization of the liquid in the exposed portion of the filter.

Figure 3:
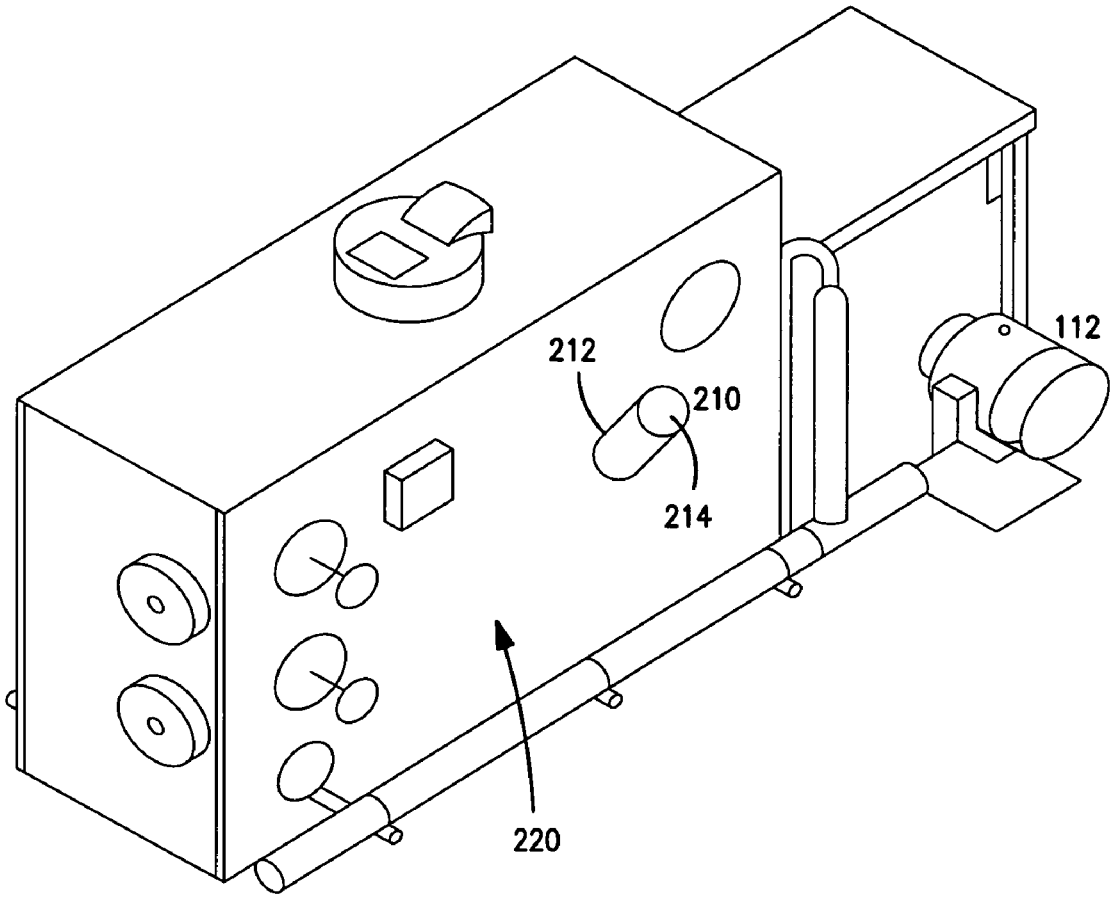
FIG. 3 is a representation viewing the angled bonnet and access flange of the system of this invention from the outside of the insulted housing.

FIG. 3 is a view from the outside of the insulated housing 220 showing filter 210 with access flange 214 exposed to the ambient air and also angled extended bonnet 212 extending outside of the insulated housing.

Although the invention has been described with reference to a certain preferred embodiment and in conjunction with a particular cryogenic process system, those skilled in the art will recognize that there are other embodiments of the invention and other cryogenic process systems within the spirit and the scope of the claims.

The invention claimed is:

1. A cryogenic process system comprising: an insulated housing; process equipment located within the insulated housing; a conduit located within the insulated housing for passing cryogenic fluid to the process equipment; and a filter assembly for filtering the cryogenic fluid passing within the conduit to the process equipment, said filter assembly having a filter housing connected to the conduit upstream of the process equipment so that the cryogenic fluid flows through the filter housing, the filter housing containing a filter element to filter the cryogenic fluid passing through the filter housing, a bonnet, at one end, connected to the filter housing and an access flange sealing the other end of the bonnet to permit access to the filter; said filter assembly positioned such that the bonnet extends through an opening of the insulated housing to outside of the insulated housing, the access flange is exposed to the ambient air and the filter housing is situated within the insulated housing, the filter assembly having no insulation such that a heat leakage exists from the outside of the insulated housing from the ambient air through the bonnet to the filter housing and the bonnet being at an angle with respect to the horizontal within the range of from 15 to 90 degrees so that the heat leakage causes a portion of the liquid in the filter housing to vaporize creating a gas trap preventing cryogenic fluid from vaporizing in the filter.

2. The cryogenic process system of claim 1 wherein the process equipment comprises a cryogenic pump.

3. The cryogenic process system of claim 1 which comprises a cryogenic air separation system.

4. The cryogenic process system of claim 1 wherein the process equipment comprises a heat exchanger.

5. The cryogenic process system of claim 1 wherein the process equipment comprises a turboexpander.

6. The cryogenic process system of claim 1 wherein the process equipment comprises a liquid turbine.

7. The cryogenic process system of claim 1 which comprises a HYCO plant.

* * * * *